US008667630B2

(12) United States Patent
Bullard

(10) Patent No.: US 8,667,630 B2
(45) **Date of Patent: *Mar. 11, 2014**

(54) FURNITURE CUSHION

(75) Inventor: Larry I. Bullard, Winston-Salem, NC (US)

(73) Assignee: L&P Property Management Company, South Gate, CA (US)

( * ) Notice: Subject to any disclaimer, the term of this patent is extended or adjusted under 35 U.S.C. 154(b) by 101 days.

This patent is subject to a terminal disclaimer.

(21) Appl. No.: 13/402,044

(22) Filed: Feb. 22, 2012

(65) Prior Publication Data

US 2013/0000044 A1 Jan. 3, 2013

Related U.S. Application Data

(63) Continuation-in-part of application No. 13/171,099, filed on Jun. 28, 2011, now Pat. No. 8,302,229.

(51) Int. Cl.
*A47C 16/00* (2006.01)

(52) U.S. Cl.
USPC ..... 5/654.1; 5/655.7; 5/737

(58) Field of Classification Search
USPC ..... 5/654.1, 721, 740, 655.6, 655.7, 716, 5/737–739, 402, 720, 657.5; 29/91, 91.1
See application file for complete search history.

(56) References Cited

U.S. PATENT DOCUMENTS

| | | | | |
|---|---|---|---|---|
| 685,160 | A | 10/1901 | Marshall | |
| 2,313,443 | A * | 3/1943 | Krakauer | 267/146 |
| 3,138,807 | A | 6/1964 | Blecker | |
| 3,178,735 | A | 4/1965 | Thompson et al. | |
| 3,923,293 | A * | 12/1975 | Wiegand | 267/94 |
| 4,234,983 | A | 11/1980 | Stumpf | |
| 4,424,600 | A * | 1/1984 | Callaway | 5/710 |
| 4,429,427 | A * | 2/1984 | Sklar | 5/654.1 |
| 4,449,261 | A * | 5/1984 | Magnusson | 5/722 |
| 4,862,540 | A * | 9/1989 | Savenije | 5/718 |
| 5,040,255 | A * | 8/1991 | Barber, Jr. | 5/720 |
| 5,127,635 | A | 7/1992 | Long et al. | |
| 5,317,768 | A * | 6/1994 | Klancnik | 5/736 |
| 5,327,596 | A * | 7/1994 | Wallace et al. | 5/655.7 |
| 6,490,744 | B1 | 12/2002 | Schulz, Jr. | |
| 7,013,515 | B1 * | 3/2006 | Price | 5/721 |
| 8,302,229 | B1 * | 11/2012 | Bullard et al. | 5/654.1 |
| 2004/0117913 | A1 * | 6/2004 | Gladney et al. | 5/720 |
| 2005/0097676 | A1 * | 5/2005 | Rensink | 5/721 |
| 2006/0116435 | A1 * | 6/2006 | Housel | 521/174 |
| 2007/0006383 | A1 * | 1/2007 | Ogle et al. | 5/698 |
| 2007/0220680 | A1 * | 9/2007 | Miller et al. | 5/739 |
| 2008/0008862 | A1 * | 1/2008 | Ogle et al. | 428/159 |
| 2011/0047710 | A1 * | 3/2011 | Beard | 5/724 |
| 2011/0073239 | A1 * | 3/2011 | Manning et al. | 156/62.2 |
| 2013/0000043 | A1 * | 1/2013 | Bullard et al. | 5/654.1 |

* cited by examiner

*Primary Examiner* — Michael Trettel
*Assistant Examiner* — Myles Throop
(74) *Attorney, Agent, or Firm* — Wood, Herron & Evans, LLP

(57) ABSTRACT

A furniture cushion comprises a matrix of interconnected pocketed springs, each spring of which is contained within a pocket of fabric. Foam at least partially surrounds the matrix. A fiber pad is wrapped bull-nose around the matrix so the pad overlies an upper surface of the matrix of pocketed springs, the fiber pad having a first layer in contact with the upper surface of the matrix of pocketed springs and a second layer in contact with the first layer, the first layer having a first density and said second layer having a second density, the first density being greater than the second density.

20 Claims, 12 Drawing Sheets

FURNITURE CUSHION

RELATED APPLICATIONS

This application is a continuation-in-part of U.S. patent application Ser. No. 13/171,099 filed Jun. 28, 2011 entitled "FURNITURE CUSHION", which is fully incorporated herein.

FIELD OF THE INVENTION

This invention relates generally to furniture cushions and, more particularly, to furniture cushions including pocketed spring cores.

BACKGROUND OF THE INVENTION

Typically, furniture cushions are commonly made in one of two types: foam core or spring core. Foam core cushions are the most common. They typically consist of a polyurethane foam core, fabricated by cutting from a larger slab or bun, and typically have a layer of polyester fiber applied to the top and bottom, or wrapped "bull-nose" top, front and bottom. Spring cushions are less common, typically preferred by higher end furniture manufacturers. They typically consist of a pocketed spring core, surrounded by a top and bottom layer of polyurethane foam, and a four-piece boxing made of polyurethane foam. The bottom layer is assembled with the boxing pieces using adhesive, the coil unit inserted into the cavity created, and the top foam layer glued in place to enclose the coil unit. The resulting assembly is then typically covered as above with a layer of polyester fiber.

There are other types of cushion constructions, usually designed for specialty markets. One such construction is the all-fiber cushion used in the outdoor furniture market. This construction contains only one type of material, although the layers of polyester fiber may be of various densities.

Foam cushions have their advantages. A foam core is very easy to fabricate—the desired thickness is slit from a bun, and the width and depth are cut from the slab. Odd shapes or sizes are easily cut from the slab or bun stock.

Foam cushions also have their disadvantages. Foam is relatively expensive; foam cost has been rising significantly faster in recent history than most other types of raw materials. The cost of foam is more volatile in general than other types of cushion components. Foam scrap from the fabricating process is not fully recyclable—it can only be shredded for use in low-value products or for making re-bonded foam. Foam loses a significant portion of its support very early in its life cycle, so a foam core cushion will lose support characteristics quickly during its life cycle, and will continue to lose support over the entire life cycle, leading to decreased consumer satisfaction and increased consumer returns. Foam has significantly less push back when a load is removed, compared to the resistance of the foam when the load is applied—this is felt by the occupant as less push from a cushion when getting up from the seated position. Foam is difficult to manufacture with consistency, and any given lot of foam will vary in its density and firmness. Foam is the most flammable of the cushion component choices. Smoldering foam creates toxic and explosive gases. Burning foam creates toxic gases. Foam cannot be manufactured with any post-consumer recycled content. Used foam is not practical to recycle.

Traditional spring cushions have their advantages. A coil spring unit (pocketed coil or otherwise) retains most of its support characteristics throughout its life cycle, so a cushion made with coils will retain more of its original support throughout use. A coil spring unit is more resilient than foam, pushing back with essentially the same force when a load is removed, as it resists the load when it is applied. Coils are typically much more consistent in firmness than foam, so any cushion made with coil content will typically be more consistent than a foam cushion.

Traditional spring cushions also have their disadvantages. Fabrication costs are higher, as the typical traditional spring cushion as described above will require six pieces of foam to be cut and sub-assembled, then assembled with the spring core. The foam component remaining in the top and bottom layers of the traditional spring cushion still share the same disadvantages as listed in the foam cushion above, although those disadvantages are proportionally less bothersome as the percentage of foam content decreases due to the use of a coil unit.

Fiber cushions have their advantages. Fiber will not retain water like foam, making it appropriate for use in outdoor cushions. Flammability is reduced compared to foam cushions, as are toxic or explosive by-products of burning. Fiber is more easily recyclable than foam.

Fiber cushions also have their disadvantages. Lofted fiber will lose height over its life cycle, which is seen as loose cushion covers and felt as a loss of overall seat height.

Finally, to make an acceptable finished cushion, the user must be insulated from the feel of the individual coils.

It is therefore an objective of this invention to reduce, or preferably eliminate, polyurethane foam from upholstered furniture cushion construction.

Another objective of this invention has been to provide a method of making a furniture cushion that reduces the labor and overhead associated with traditional methods of coil cushion construction.

Yet another objective of this invention has been to accomplish the previous objectives without compromising the ability to insulate the user from the feel of the individual coils.

SUMMARY OF THE INVENTION

Accordingly, in one aspect, the invention is a furniture cushion comprising a matrix of interconnected pocketed springs, each spring of which is contained within a pocket of fabric. Foam surrounds at least three sides of the matrix of interconnected pocketed springs to create a foam assembly. A fiber pad is wrapped bull-nose around the foam assembly so as to cover or overlay an upper surface of the matrix of pocketed springs, the fiber pad having a first layer in contact with the upper surface of the matrix of pocketed springs and a second layer in contact with the first layer, the first layer having a first density and the second layer having a second density, the first density being greater than the second density.

The fiber can be polyester fiber. The first layer can be a needle punched densified layer of polyester fiber and the second layer can be a loft layer of polyester fiber. The first density can range from about 3 pounds per cubic foot to about 10 pounds per cubic foot, and the second density can range from about 0.5 pounds per cubic foot to about 2.5 pounds per cubic foot. The fiber pad may underlie a lower surface of the matrix of pocketed springs, the first layer of the second fiber pad in contact with the lower surface of the matrix of pocketed springs and the second layer of the second fiber pad in contact with the first layer of the second fiber pad. The matrix of pocketed springs includes a pair of opposed side edges and a pair of opposed end edges. An upholstery cover may surround the fiber pad and foam assembly. The springs can be formed to be taller than the pockets, whereby the springs are preloaded in the pockets.

In another aspect, the invention is a furniture cushion comprising a foam assembly comprising a matrix of interconnected pocketed springs, each spring of which is contained within a pocket of fabric, and foam surrounding the matrix of interconnected pocketed springs. A fiber pad is wrapped bull-nose around the foam assembly so as to cover an upper surface, a front end edge, and a lower surface of the matrix of pocketed springs, the fiber pad having a first layer in contact with the upper and lower surfaces of the matrix of pocketed springs and a second layer in contact with the first layer, the first layer having a first density and the second layer having a second density, the first density being greater than the second density.

The fiber can be polyester fiber. The first layer can be a needle punched densified layer of polyester fiber, and the second layer can be a loft layer of polyester fiber. The first density can range from about 3 pounds per cubic foot to about 10 pounds per cubic foot, and the second density can range from about 0.5 pounds per cubic foot to about 2.5 pounds per cubic foot. The matrix of pocketed springs includes a pair of opposed side edges and a rear end edge and an upholstery cover surrounding the fiber pad and foam assembly. The springs can be formed to be taller than the pockets, whereby the springs are pre-loaded in the pockets.

In yet another aspect, the invention is a furniture cushion comprising a matrix of interconnected pocketed springs, each spring of which is contained within a pocket of fabric, a foam pad overlying an upper surface of the matrix of pocketed springs, and a fiber pad overlying an upper surface of the foam pad.

The foam can be polyethylene foam, and the fiber can be polyester fiber. The density of the polyethylene foam can range from about 1.5 pounds per cubic foot to about 2.0 pounds per cubic foot, and the density of the polyester fiber can range from about 0.5 pounds per cubic foot to about 2.5 pounds per cubic foot. The foam pad and fiber pad can be wrapped bull-nose around the matrix of pocketed springs so as to cover an upper surface, a front end edge, and a lower surface of the matrix of pocketed springs. The matrix of pocketed springs includes a pair of opposed side edges and a rear end edge; the cushion further comprises an edge loft layer of polyester fiber on each of the opposed side edges and rear end edge of the matrix of pocketed springs, and an upholstery cover surrounding the fiber pads and the edge fiber loft layers. The springs can be formed to be taller than the pockets, whereby the springs are pre-loaded in the pockets.

In yet another aspect, a furniture cushion comprises a matrix of interconnected pocketed springs, each spring of which is contained within a pocket of fabric. A foam border surrounds three sides of the matrix of interconnected pocketed springs. A fiber pad is wrapped bull-nose around the matrix of pocketed springs so as to cover an upper surface, front end edges and a lower surface of the matrix of pocketed springs. The fiber pad may have a first layer in contact with the upper surface of the matrix of springs and a second layer in contact with the first layer, the first layer having a first density and the second layer having a second density, the first density being greater than the second density.

The fiber can be polyester fiber. The first layer can be a needle punched densified layer of polyester fiber, and the second layer can be a loft layer of polyester fiber. The first density can range from about 3 pounds per cubic foot to about 10 pounds per cubic foot, and the second density can range from about 0.5 pounds per cubic foot to about 2.5 pounds per cubic foot. The fiber pad can be wrapped bull-nose around the matrix of springs so as to cover an upper surface, a front end edge, and a lower surface of said matrix of springs.

One advantage of the present invention is that polyurethane foam is reduced or eliminated from upholstered furniture cushion construction.

Another advantage of the present invention is that a method of making a furniture cushion is provided that reduces the labor and overhead associated with traditional methods of coil cushion construction.

Yet another advantage of the present invention is that the previous advantages have been provided without compromising the ability to insulate the user from the feel of the individual coils.

These and other objectives and advantages of the present invention will become more readily apparent during the following Detailed Description in conjunction with the Drawings herein.

DETAILED DESCRIPTION OF THE DRAWINGS

Figure 1:
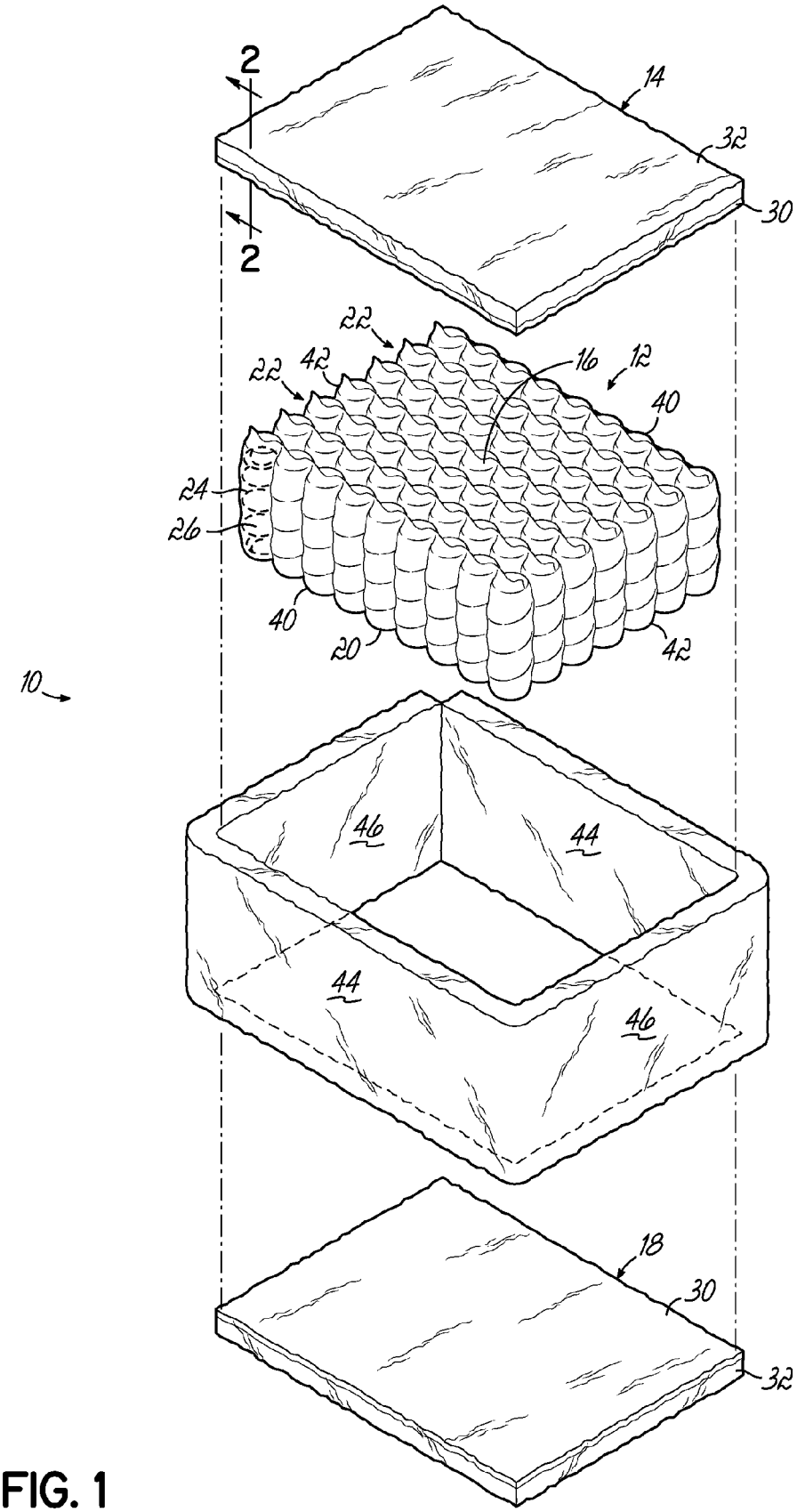
FIG. 1 is an exploded perspective view of one embodiment of the furniture cushion of the present invention.
Figure 2:
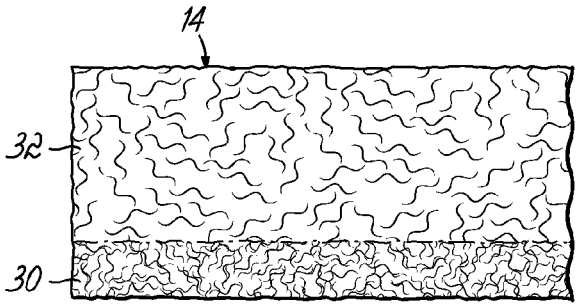
FIG. 2 is a cross-sectional view taken along line 2-2 in FIG. 1.
Figure 3:
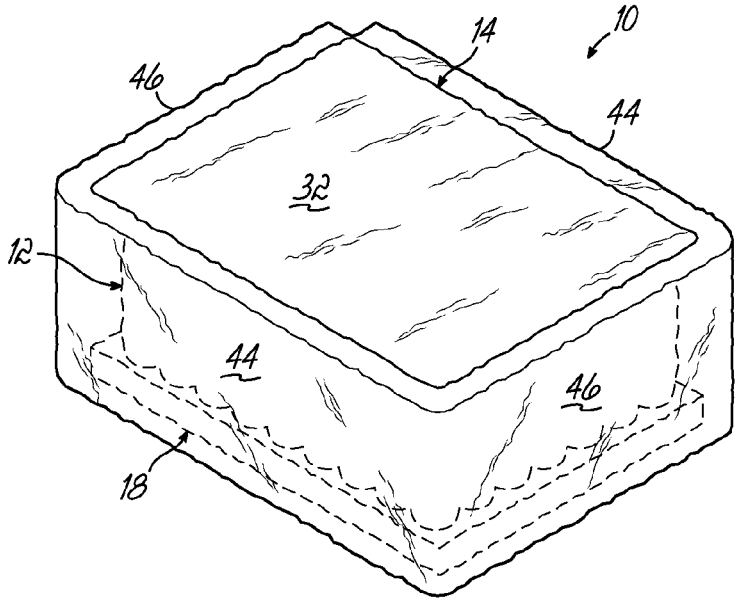
FIG. 3 is an assembled perspective view of the furniture cushion of FIGS. 1 and 2.
Figure 4:
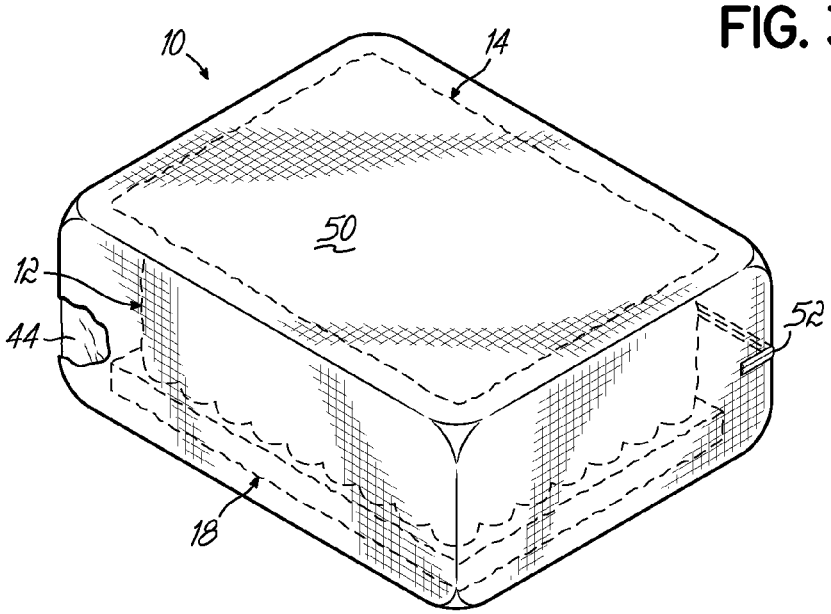
FIG. 4 is a perspective view of the furniture cushion of FIGS. 1-3 with upholstery cover secured thereover.

Referring to FIGS. 1-4, one embodiment of furniture cushion 10 according to the principals of the present invention is illustrated. The cushion 10 includes a matrix 12 of interconnected pocketed springs, a first fiber pad 14 overlying an upper surface 16 of the matrix 12 of pocketed springs, and a second fiber pad 18 underlying a lower surface 20 of the matrix 12 of pocketed springs. The matrix 12 of interconnected pocketed springs are formed in continuous strips 22, are cut to a specified length, and then assembled to other strips 22 of coils by side gluing or the like. Since this embodiment 10 of cushion eliminates the top and bottom foam layers, and the edge boxing foam pieces, the matrix 12 of pocketed springs is significantly taller, wider and deeper than traditional spring cushions. One preferred shape of pocketed coil is barrel-shaped, although the pocketed coil could be cylindrical or hour-glass shaped. The coil 24 is formed to be taller than the pocket 26 that contains it, creating a condition wherein the coil 24 is pre-loaded in the pocket 26. The comfort of the cushion 10 can be controlled by the gauge, diameter, and number of convolutions of the wire in the coils 24. The final dimensions of the cushions can be controlled by the height and diameter of the pocketed coils, and the number of coils per row and number of rows of coils per unit. Other types of coil units other than pocketed coils could also be utilized.

The fiber pad 14 includes a first layer 30 in contact with the upper surface 16 of the matrix 12 of pocketed springs, and a second layer 32 in contact with the first layer 30. The first layer 30 has a first density, and the second layer 32 has a second density; the first density is greater than the second density. The dual density fiber pad 14 can be fabricated of polyester fiber. The first layer 30 can be a needle punched densified layer of polyester, and the second layer 32 can be a loft layer of polyester fiber. This construction insulates the user from the feel of the individual coils. The densified layer 30 of polyester fiber can have a density ranging from about 3 pounds per cubic foot to about 10 pounds per cubic foot, with about 5 pounds per cubic foot being preferred. The densified layer 30 can range from about ⅛ inch thick to about ¼ inch thick. The loft layer 32 of polyester fiber can have a density ranging from about 0.5 pounds per cubic foot to about 2.5 pounds per cubic foot, with about 1.0 pounds per cubic foot being preferred. The loft layer 32 can range from about 1 inch thick to about 2 inches thick. The second fiber pad 18 is of similar construction; the first layer 30 thereof is in contact with the lower surface 20 of the matrix 12 of pocketed coils, and the second layer 32 thereof is in contact with the first layer 30. The layers 30 and 32 of the pads 14, 18 are preferably mechanically joined (as by needle punching) or bonded together by low melt fibers or other bonding agents. One suitable commercially available dual density polyester fiber pad is the 3.0 (ounce per square foot) PLV, available from Thomasville-Dexel, Inc., located in High Point, N.C.

The matrix 12 of pocketed coils includes a pair 40, 40 of opposed side edges and a pair 42, 42 of opposed end edges. The cushion 10 can further include an edge loft layer 44 of polyester on each of the opposed side edges 40, 40 of the matrix 12 of interconnected pocketed springs, and an edge loft layer 46 of polyester on each of the opposed end edges 42, 42 of the matrix 12 of interconnected pocketed springs. The edge loft layers 44, 46 can be a single length of loft polyester fiber, as illustrated, or any number of separate lengths of loft polyester fiber. The edge loft layers preferably have a density of about 0.5 pounds per cubic foot.

Finally, the cushion 10 can include an upholstery cover 50 surrounding the matrix 12 of pocketed springs, upper pad 14, lower pad 18, and edge layers 44, 46. The cover 50 can include a suitable closure mechanism, such as zipper 52.

Figure 5:
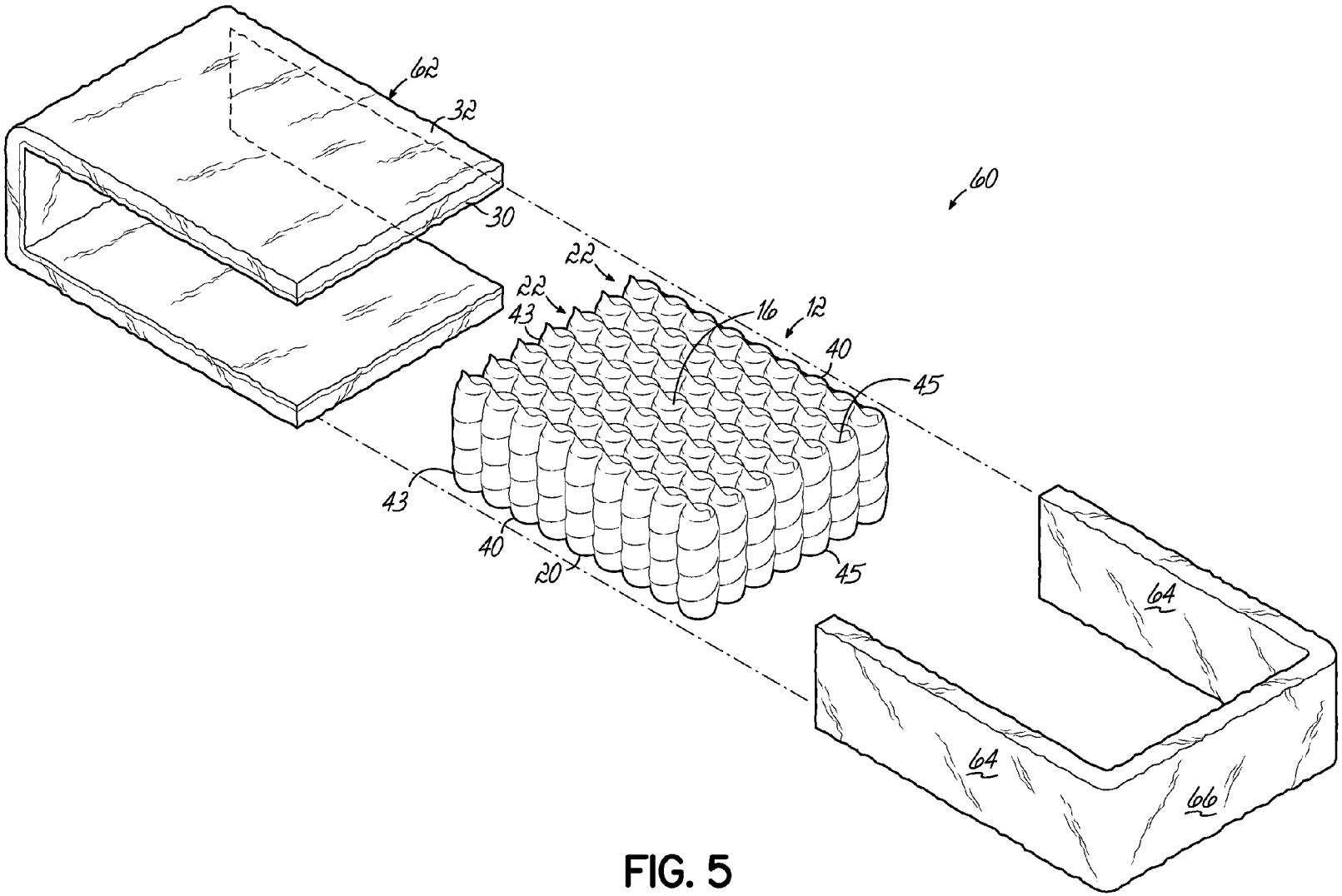
FIG. 5 is an exploded perspective view of another embodiment of the furniture cushion of the present invention.
Figure 6:
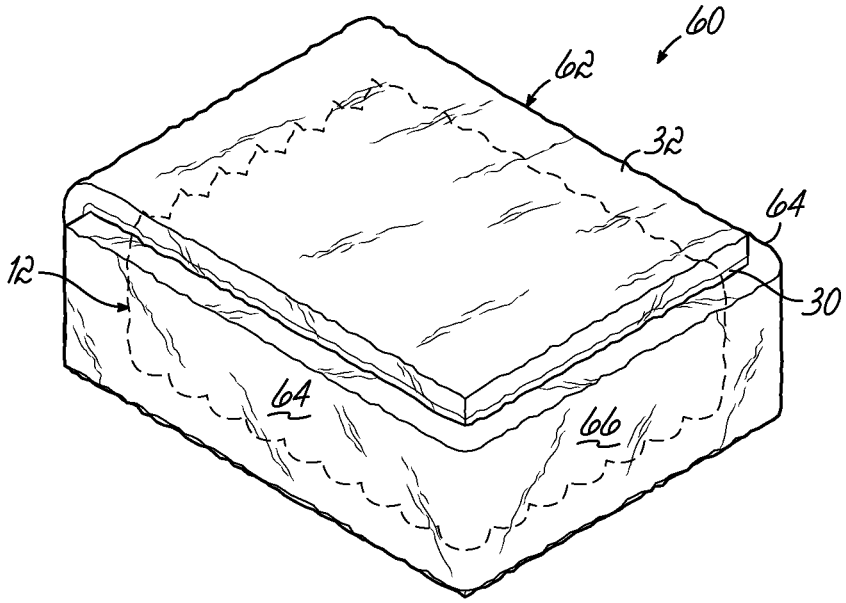
FIG. 6 is an assembled perspective view of the furniture cushion of FIG. 5.

Referring to FIGS. 5 and 6, another embodiment of cushion 60 according to the principals of the present invention is illustrated. With like numbers representing like elements from the previous embodiment, a fiber pad 62 is wrapped bull-nose around the matrix 12 of pocketed spring core 12 so as to cover the upper surface 16, front end edges 43, and lower surface 20 of the matrix 12. As in the prior embodiment, the fiber pad 62 includes a first densified layer of polyester fiber 30 and a second loft layer of polyester fiber 32. The densified layer 30 is in contact with the upper surface 16, front end edges 43, and lower surface 20 of the matrix 12 of pocketed springs, and the loft layer 32 is in contact with the densified layer 30. The layers 30 and 32 can have the same properties as mentioned above in connection with the first embodiment of cushion 10. The cushion 60 can further include an edge loft layer 64 on each of the opposed side edges 40, 40 of the matrix 12 of pocketed springs, and an edge loft layer 66 on the rear end edges 45 of the matrix 12 of pocketed springs.

Figure 7:
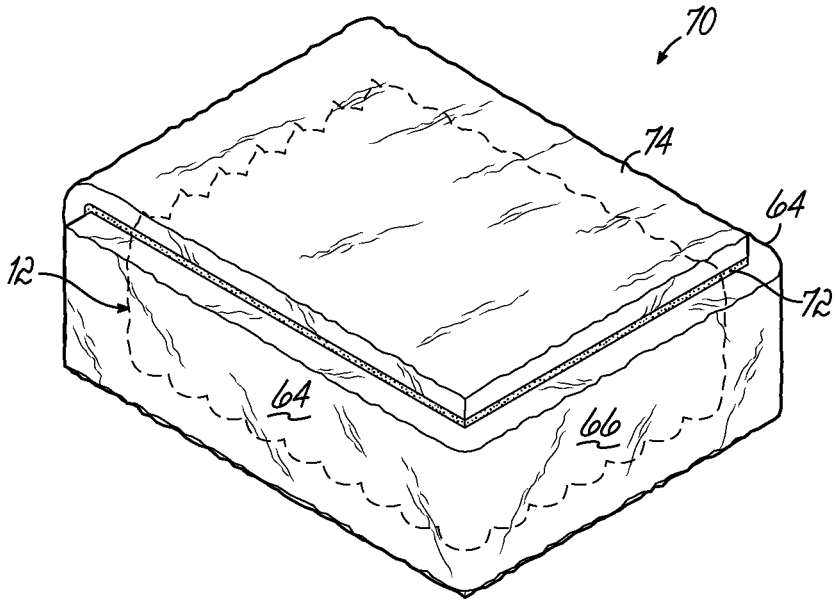
FIG. 7 is an assembled perspective view of another embodiment of furniture cushion of the present invention.

Referring to FIG. 7, another embodiment of cushion 70 according to the principals of the present invention is illustrated. With like numbers representing like elements from previous embodiments, in this embodiment, rather than using the dual density polyester fiber pad as in the previous embodiments, a foam pad 72 is wrapped bull-nose around the matrix 12 of pockets springs, and a fiber pad 74 is wrapped bull-nose around the foam pad 72. The foam pad 72 can be virgin foam, re-bonded foam, or closed cell foam, such as polyethylene foam. The foam pad 72 is preferably polyethylene foam, with a density ranging from about 1.5 pounds per cubic foot to about 2.0 pounds per cubic foot, with about 1.8 pounds per cubic foot being preferred. The foam pad 72 can be about ¼ inch thick. The fiber pad 74 is preferably of the construction of the second loft layer 32 (and edge loft layers) described above in connection with the first two embodiments of cushion. As in the previous embodiments, the cushion 70 can further include an edge loft layer 64 on opposed side edges 40, 40 of the matrix 12 of pocketed springs, and an edge loft layer 66 on the rear end edges 45 of the matrix 12 of pocketed springs. In this embodiment, the foam pad 72 functions as the insulator to insulate a user from the coils, similar to the densified layer 30 of the polyester fiber of the previous embodiments. While this embodiment does not completely eliminate foam as a component of the cushion like the previous embodiments do, it at least reduces or minimizes it.

Figure 8:
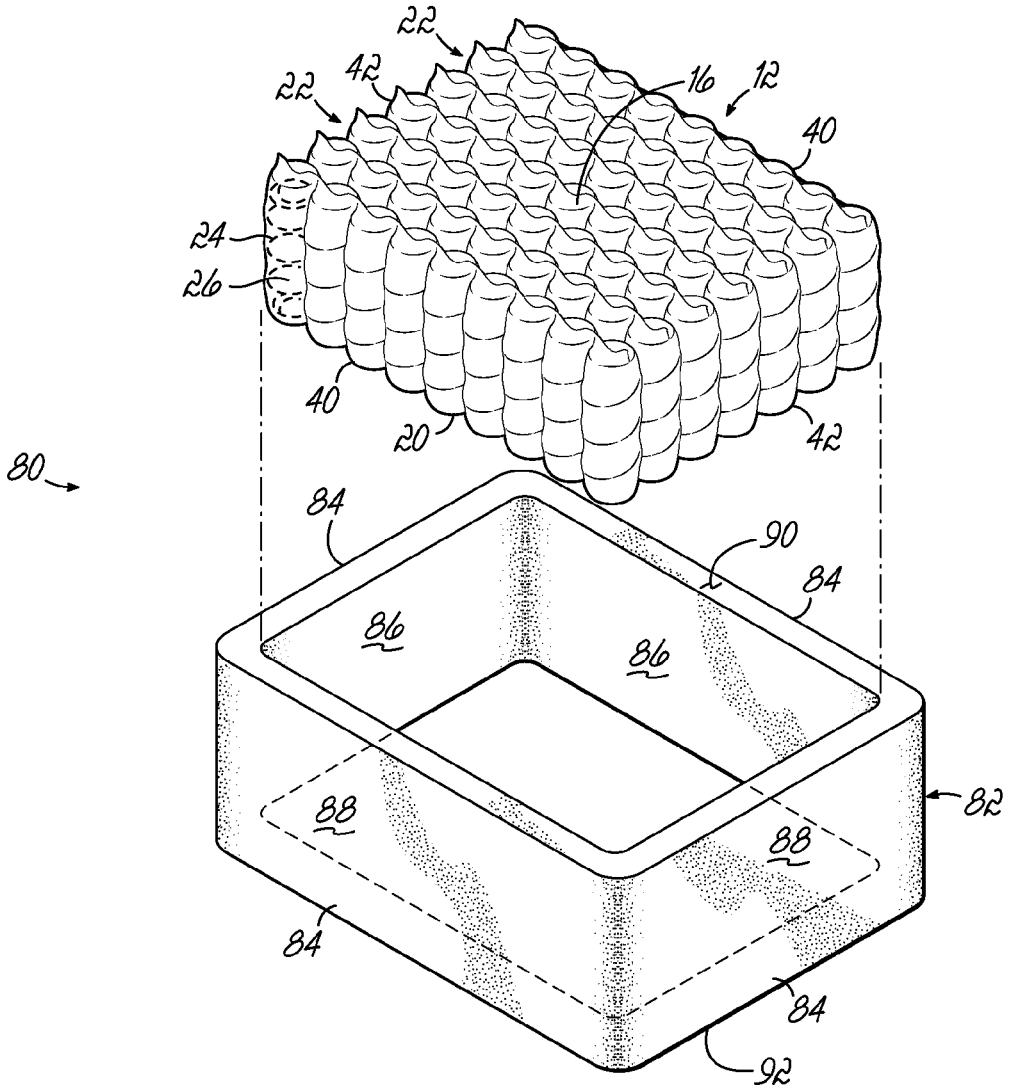
FIG. 8 is a partially disassembled perspective view of a portion of another embodiment of furniture cushion.
Figure 9:
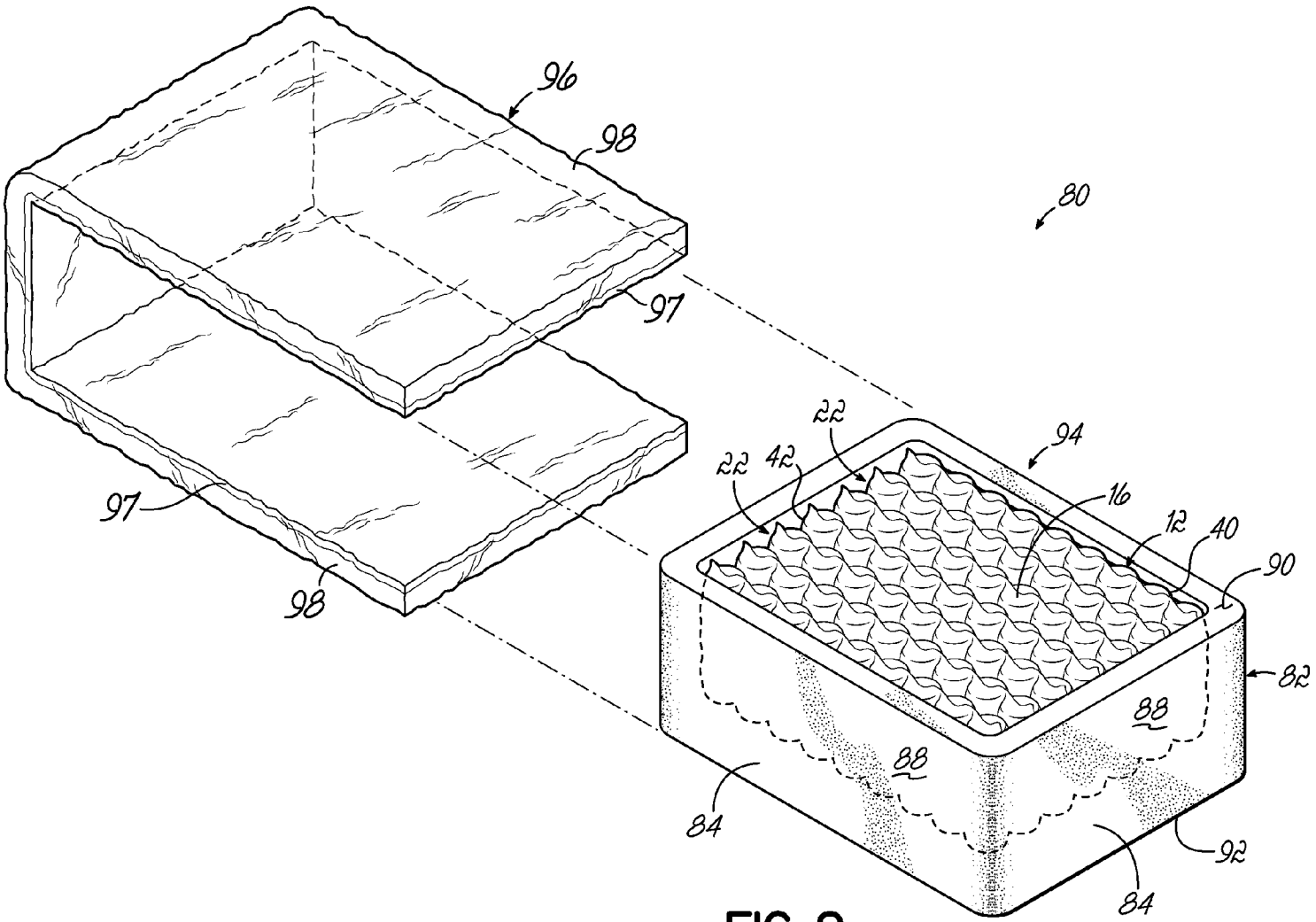
FIG. 9 is a partially disassembled perspective view of a portion of the furniture cushion of FIG. 11.

Referring to FIGS. 8-11, another embodiment of cushion 80, according to the principals of the present invention, is illustrated along with its method of manufacture. With like numbers representing like elements from the previous embodiments, a matrix 12 of pocketed springs is placed inside a foam border 82, as shown in FIGS. 8 and 9. The foam border 82 has four sides 84, an inside surface 86, an outside surface 88, an upper surface 90 and a lower surface 92. Although the foam border 82 is shown as one piece, it may be made of any number of pieces combined.

The foam used for the foam border 82 may be any conventional upholstery seat cushioning foam. Typically, such foam is polyurethane, having a density between 1.5 and 2.2 pounds per cubic foot. The firmness of the foam is expressed in Indention Force Deflection ("IFD"). The foam used for the foam border 82 may have an IFD between 20 and 36 pounds, with 24 to 28 pounds being preferable. One suitable foam border used in this invention comprises polyurethane foam having an IFD of 28 pounds and a density of 1.8 pounds per cubic foot.

FIG. 9 shows the foam border 82 surrounding the matrix 12 of pockets springs to form a foam assembly 94. The foam assembly 94 is wrapped bull-nose with a fiber pad 96. The fiber pad 96 may be made of the same material as fiber pad 14 and includes a first densified layer of polyester fiber 97 and a second loft layer of polyester fiber 98 in contact with the first layer of polyester fiber 97.

Figure 10:
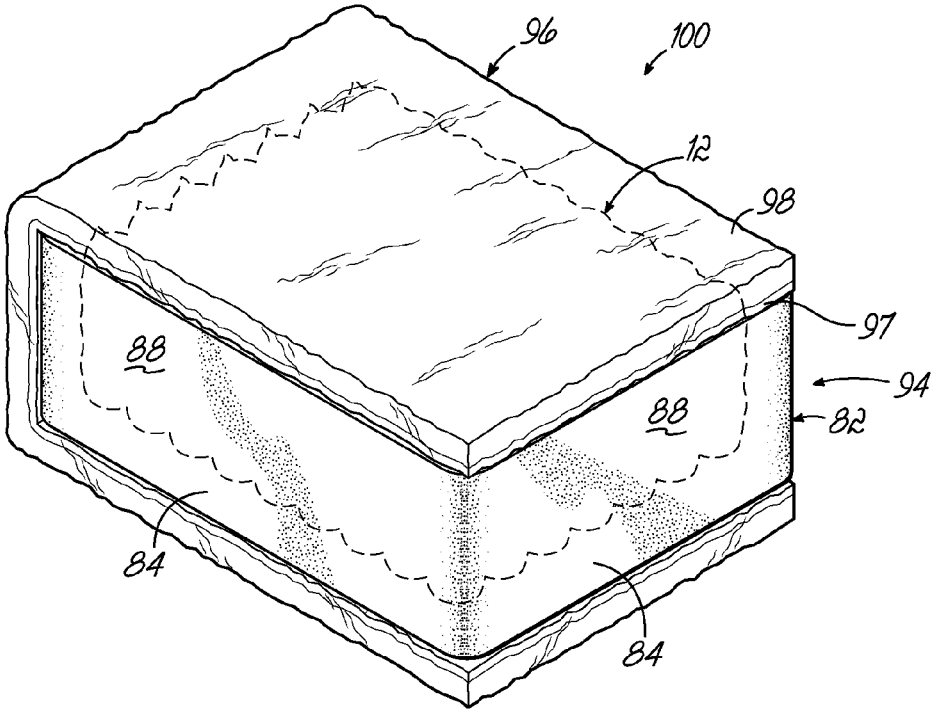
FIG. 10 is a perspective view of the furniture cushion of FIG. 11 without the covering.

Referring to FIGS. 9 and 10, fiber pad 96 is wrapped bull-nose around the foam assembly 94 so as to cover the upper and lower surfaces 16, 20 of the matrix 12. As in the prior embodiments, the fiber pad 96 includes a first densified layer of polyester fiber 97 and a second loft layer of polyester fiber 98. The densified layer 97 is in contact with the upper and lower surfaces 16, 20 of the matrix 12 of pocketed springs, and the loft layer 98 is in contact with the densified layer 97. The layers 97 and 98 can have the same properties as mentioned above in connection with the first embodiment of cushion 10.

As shown in FIG. 10, the fiber pad 96 may contact one outer side surface 88 and the upper and lower surfaces 90, 92 of the form border 82 of foam assembly 94. More particularly, the densified layer 97 of fiber pad 96 may contact one outer side surface 88 along with the upper and lower surfaces 90, 92 of the form border 82 of foam assembly 94. As shown in FIG. 10, the fiber pad 96 wrapped bull-nose around the foam assembly 94 comprises a subassembly 100. As shown in FIG. 10, three of the four sides of the foam border 82 are exposed, with the remaining front side of the foam border 82 being covered by the fiber pad 96.

Figure 11:
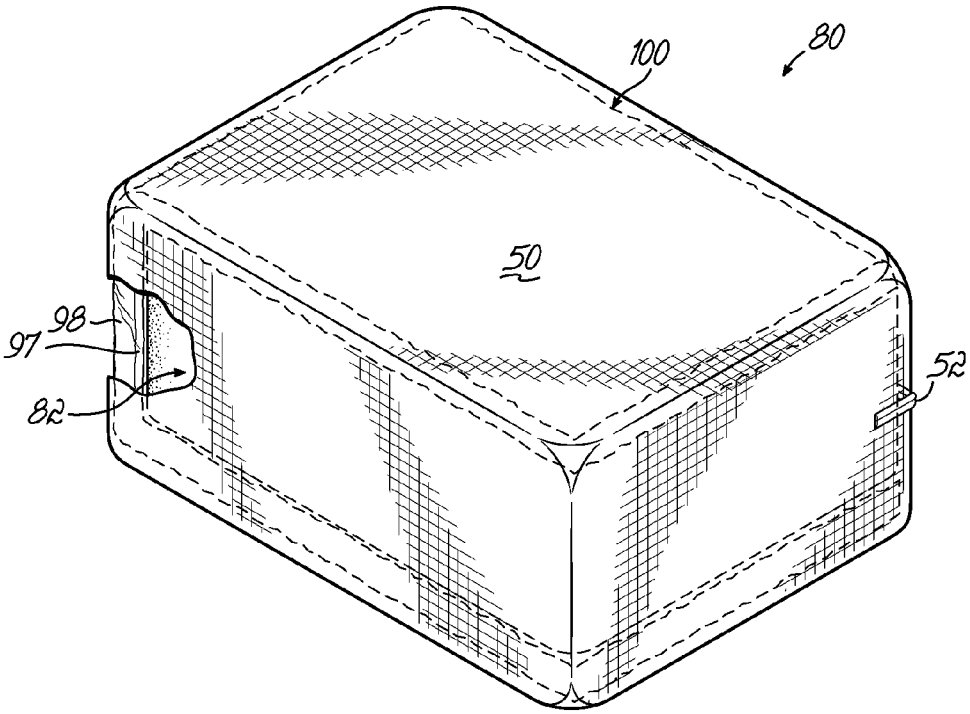
FIG. 11 is a perspective view of the embodiment of furniture cushion shown in FIGS. 8, 9 and 10.

As shown in FIG. 11, the cushion 80 can include an upholstery cover 50 surrounding the subassembly 100. The cover 50 can include a suitable closure mechanism, such as zipper 52.

The method of making a cushion 80 shown in FIG. 11 eliminates the need to use multiple pieces of border fiber to encase a matrix or assembly of pocketed springs.

Figure 12:
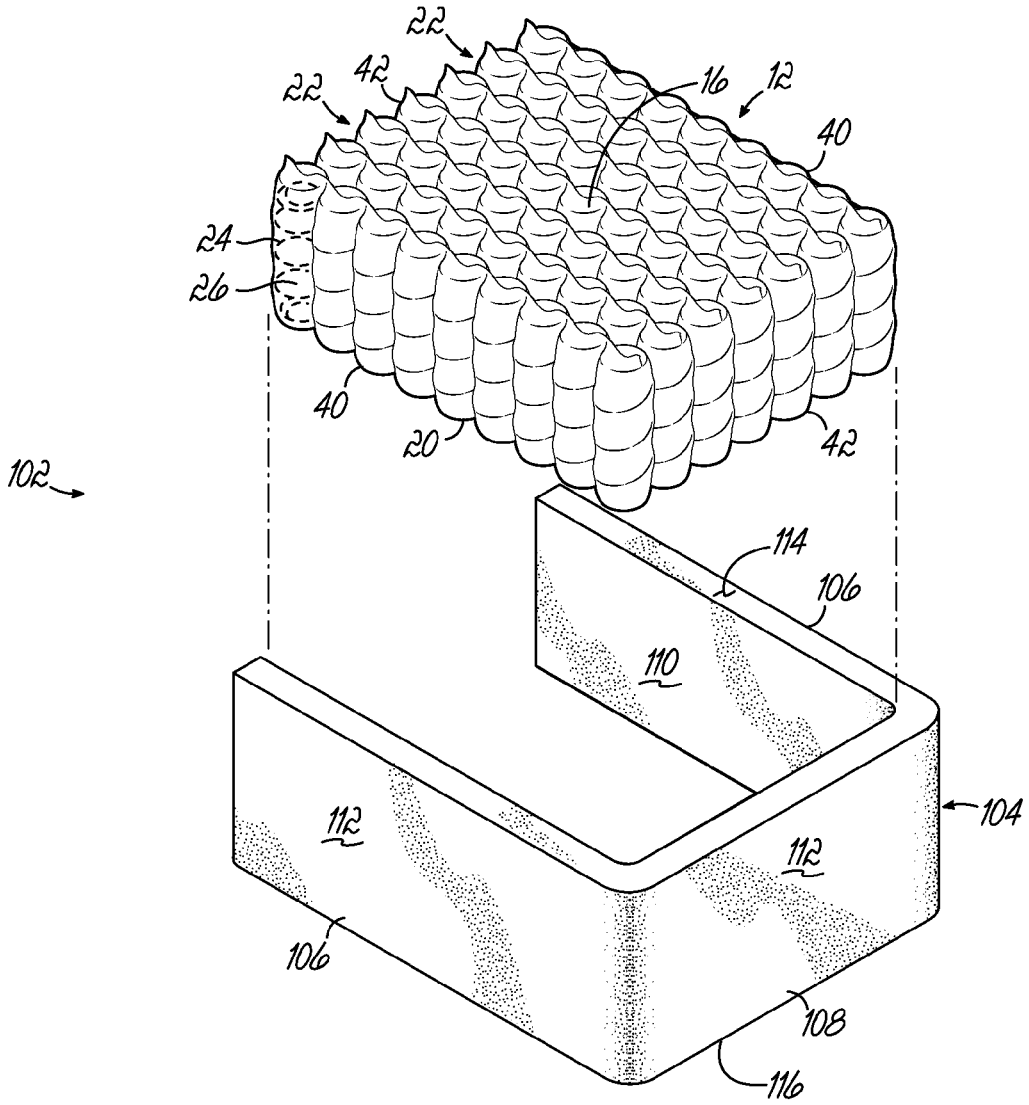
FIG. 12 is a partially disassembled perspective view of a portion of another embodiment of furniture cushion.
Figure 13:
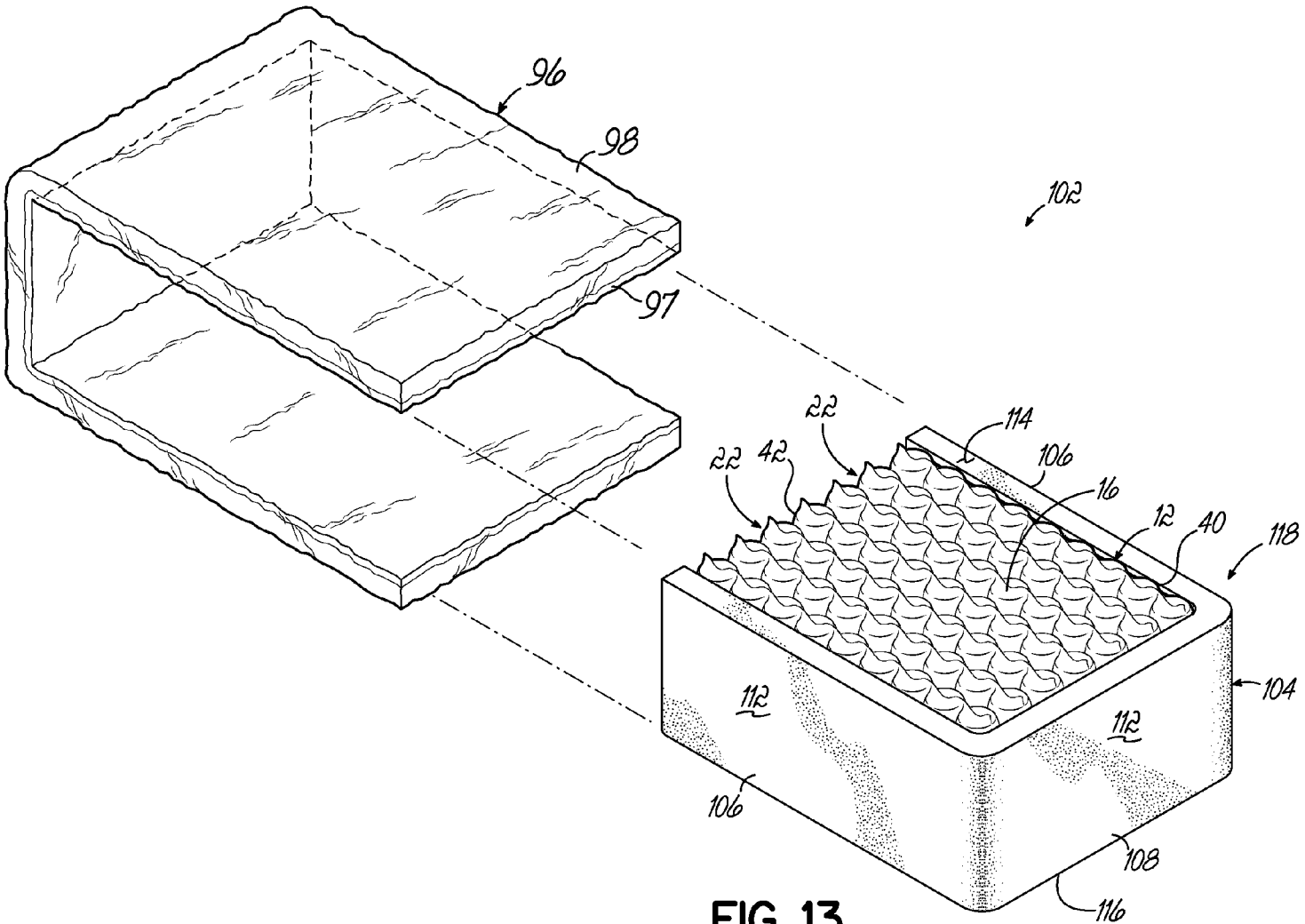
FIG. 13 is a partially disassembled perspective view of a portion of the furniture cushion of FIG. 15.

Referring to FIGS. 12-15, another embodiment of cushion 102, according to the principals of the present invention, is illustrated along with its method of manufacture. With like numbers representing like elements from the previous embodiments, a matrix 12 of pocketed springs is placed inside a partial or three-sided foam border 104, as shown in FIGS. 12 and 13. The foam border 104 has a generally U-shape comprising two sides 106 and a rear 108, an inside surface no, an outside surface 112, an upper surface 114 and a lower surface 116. Although the foam border 104 is shown as one piece, it may be made of any number of pieces combined. The foam used for the foam border 104 may be any conventional upholstery seat cushioning foam as described above with regards to foam border 82.

FIG. 13 shows the foam border 104 partially surrounding (on three sides) the matrix 12 of pocketed springs to form a foam assembly 118. The foam assembly 118 is wrapped bull-nose with a fiber pad 96. The fiber pad 96 may be made of the same material as fiber pad 14 and the fiber pad 96 of the embodiment shown in FIGS. 8-11 and described herein.

Figure 14:
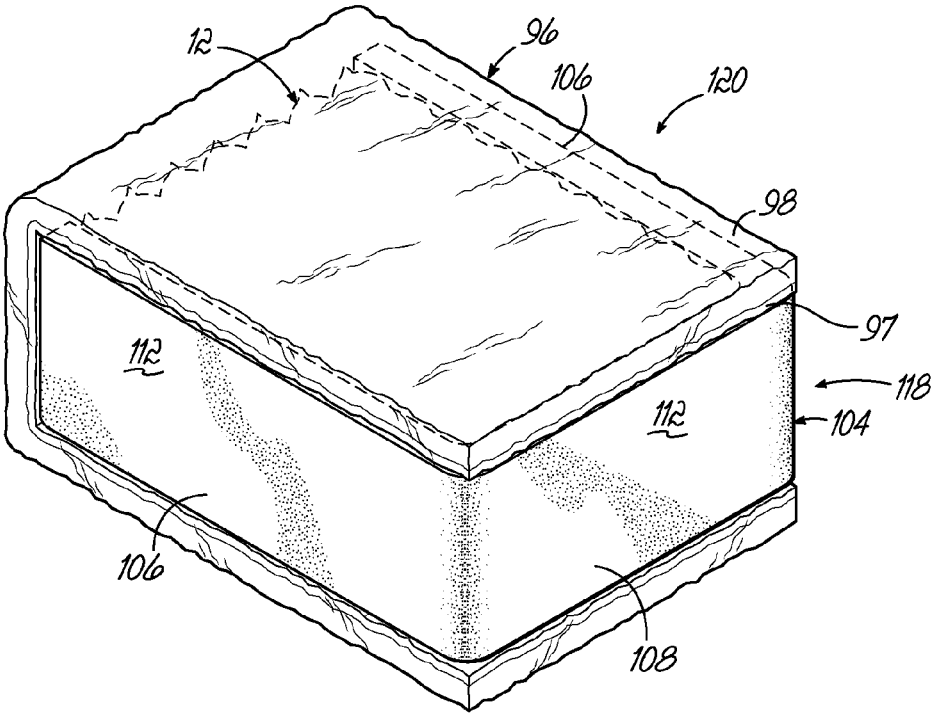
FIG. 14 is a perspective view of the furniture cushion of FIG. 15 without the covering.

Referring to FIGS. 13 and 14, fiber pad 96 is wrapped bull-nose around the foam assembly 118 so as to cover the upper and lower surfaces 16, 20 of the matrix 12. As in the prior embodiments, the fiber pad 96 includes a first densified layer of polyester fiber 97 and a second loft layer of polyester fiber 98. The densified layer 97 is in contact with the upper and lower surfaces 16, 20 of the matrix 12 of pocketed springs, and the loft layer 98 is in contact with the densified layer 97. The layers 97 and 98 can have the same properties as mentioned above in connection with the first embodiment of cushion 10.

As shown in FIG. 14, the fiber pad 96 contacts the upper and lower surfaces 16, of the matrix 12 of pocketed springs and the upper and lower surfaces 114, 116 of the form border 104 of foam assembly 118. More particularly, the densified layer 97 of fiber pad 96 contacts the upper and lower surfaces 16, 20 of the matrix 12 of pocketed springs. In addition, the fiber pad 96 contacts top and bottom front edges 42 of the matrix 12 of pocketed springs along with the upper and lower surfaces 114, 116 of the form border 104 of foam assembly 118. As shown in FIG. 14, the fiber pad 96 wrapped bull-nose around the foam assembly 118 comprises a subassembly 120. As shown in FIG. 14, three of the four sides of the foam border 104 are exposed, with the remaining front side of the foam border 104 being covered by the fiber pad 96.

Figure 15:
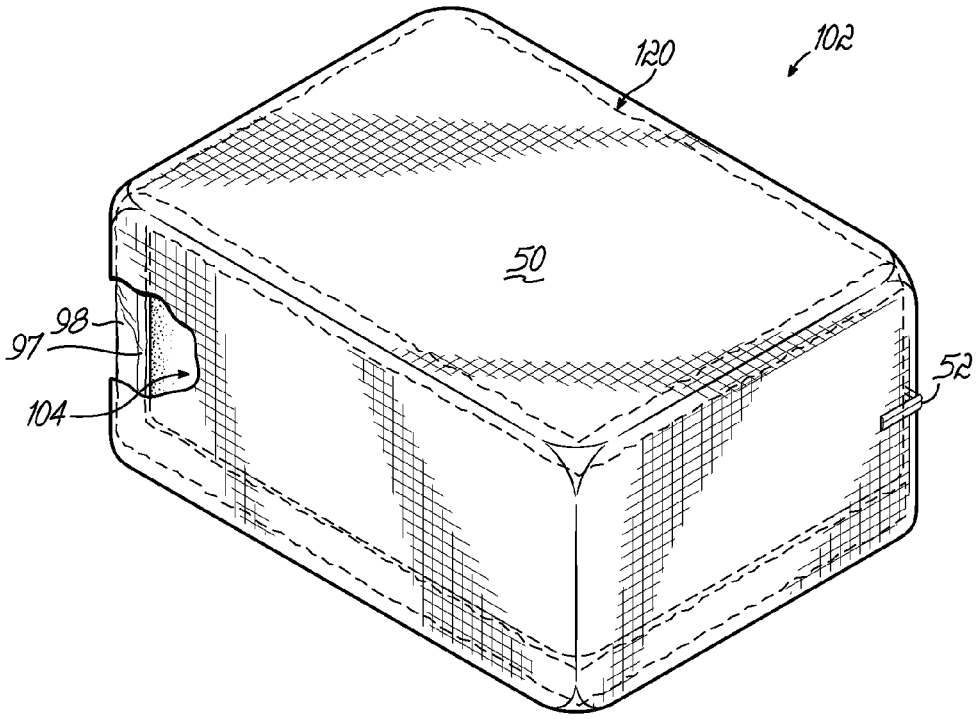
FIG. 15 is a perspective view of the embodiment of furniture cushion shown in FIGS. 12, 13, 14 and 15.

As shown in FIG. 15, the cushion 102 can include an upholstery cover 50 surrounding the subassembly 120. The cover 50 can include a suitable closure mechanism, such as zipper 52.

Figure 16:
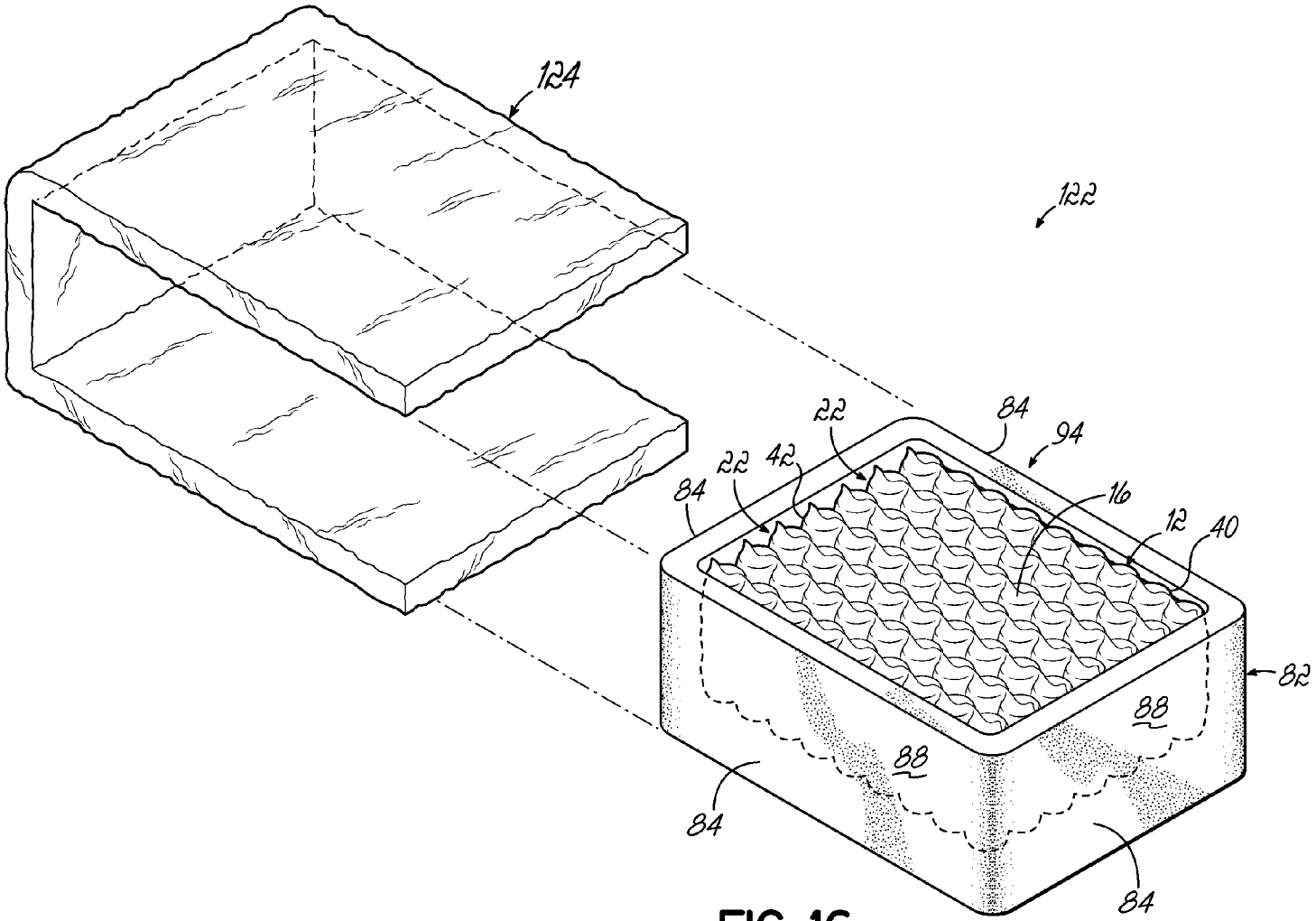
FIG. 16 is a partially disassembled perspective view of a portion of another embodiment of furniture cushion.
Figure 17:
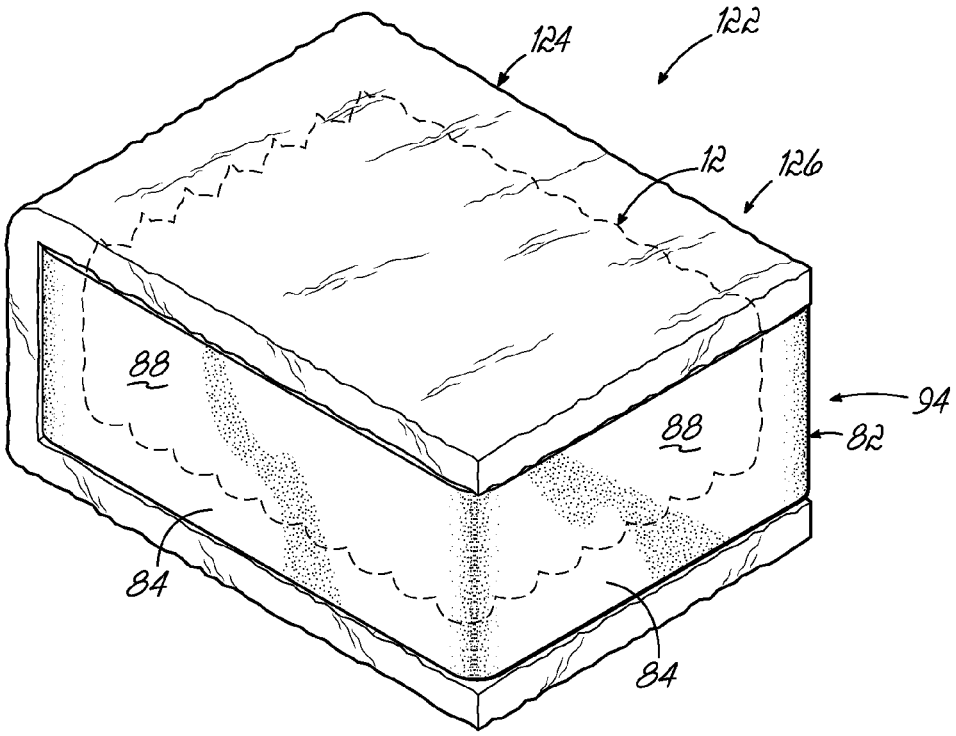
FIG. 17 is a perspective view of a portion of the furniture cushion of FIG. 18.
Figure 18:
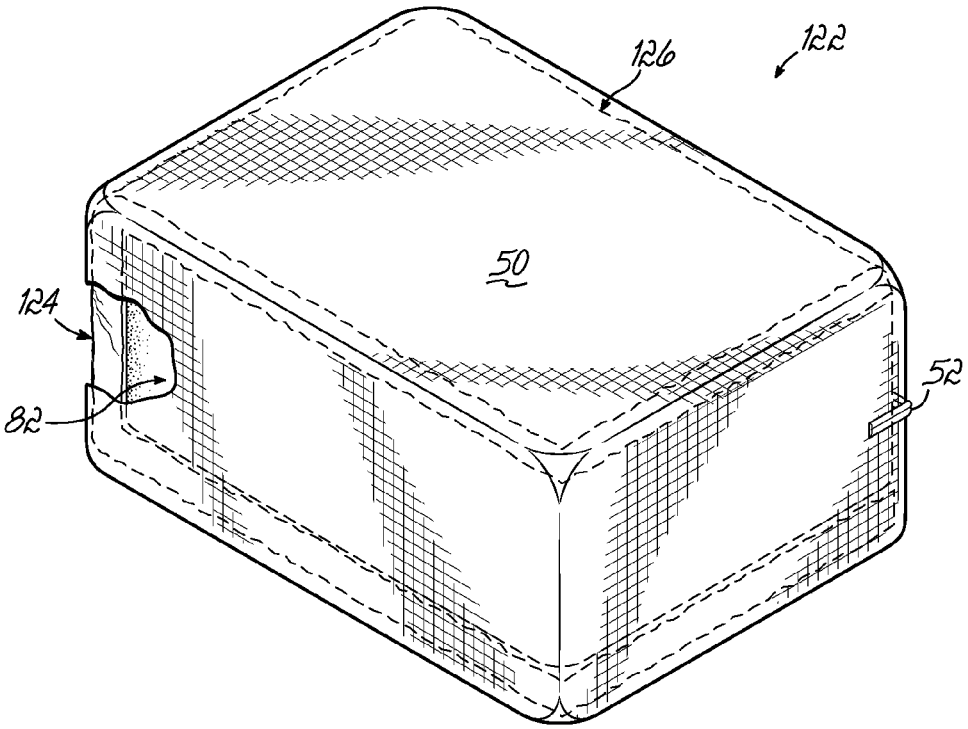
FIG. 18 is a perspective view of the embodiment of furniture cushion shown in FIGS. 16 and 17.

The method of making a cushion 102 shown in FIG. 15 eliminates the need to use multiple pieces of border fiber to encase a matrix or assembly of pocketed springs. Referring to FIGS. 16-18, another embodiment of cushion 122, according to the principals of the present invention, is illustrated along with its method of manufacture. With like numbers representing like elements from the previous embodiments, a matrix 12 of pocketed springs is placed inside a four-sided foam border 82. The foam border used in this embodiment may alternatively be a three-sided foam border like the foam border 104 of the embodiment of FIGS. 12-15. The foam border 82 is identical to the foam border shown in FIGS. 8-11 and described herein. Although the foam border 82 is shown as one piece, it may be made of any number of pieces combined.

FIG. 16 shows the foam border 82 surrounding (on four sides) the matrix 12 of pocketed springs to form a foam assembly 82. The foam assembly 82, identical to the foam assembly shown in FIGS. 8-11 and described herein, is wrapped bull-nose with a fiber pad 124. The fiber pad 124 may be made of different material than the fiber pad 96 of the embodiments shown in FIGS. 8-15 and described herein.

Referring to FIGS. 16 and 17, fiber pad 124 is wrapped bull-nose around the foam assembly 94 so as to cover the upper and lower surfaces 16, 20 of the matrix 12. The fiber pad 124 includes a single densified layer of polyester fiber.

As shown in FIG. 17, the fiber pad 124 contacts the upper and lower surfaces 16, 20 of the matrix 12 of pocketed springs and the upper and lower surfaces 90, 92 of the form border 82 of foam assembly 94. The fiber pad 124 further contacts one outer side surface 88 and the upper and lower surfaces 90, 92 of the form border 82 of foam assembly 94. As shown in FIG. 17, the fiber pad 124 wrapped bull-nose around the foam assembly 94 comprises a subassembly 126. As shown in FIG. 17, three of the four sides of the foam border 82 are exposed, with the remaining front side of the foam border 82 being covered by the fiber pad 124.

As shown in FIG. 18, the cushion 122 can include an upholstery cover 50 surrounding the subassembly 126. The cover 50 can include a suitable closure mechanism, such as zipper 52.

The method of making a cushion 122 shown in FIG. 18 eliminates the need to use multiple pieces of border fiber to encase a matrix or assembly of pocketed springs.

The inventions described herein have a number of advantages. The cost of coil and fiber components are rising less quickly than foam, and tend to be more stable over time. The embodiments of FIGS. 1-6 completely eliminate foam; the embodiments of FIGS. 7-18 minimize, or at least reduce, the amount of foam used.

Manufacturing labor and resulting overhead costs are minimized. The coil units have come to be manufactured by highly automated processes. By maximizing the coil content of the cushion, the labor content of the cushion is minimized. Eliminating foam (FIGS. 1-6 embodiments) eliminates the need to cut and assemble multiple foam components. The fiber components may be designed to be supplied in standardized widths to match the coil unit width and height, so the only fabrication cost of the fiber is to cut it off the roll to the finished length needed to apply to the coil unit. The assembly process of the cushion is designed to minimize the number of fiber components needed, and to minimize the application time: one piece of dual density fiber may be applied bull-nose to the coil unit (or two pieces for the boxed variation), and one strip of single density fiber may be applied by wrapping around the three (or four) remaining sides of the cushion. The use of the dual density fiber component, while not required, is preferred, to eliminate the added step of applying a separate insulator layer to the coil unit. Alternatively, one piece of fiber may be used to completely encase a matrix of pocketed springs.

The advantages of coil spring units are similar to those listed for the traditional spring cushion above, but are maximized due to the maximized coil content. A coil spring unit (pocketed coil or otherwise) retains most of its support characteristics throughout its life cycle, so a cushion made with coils will retain more of its original support throughout use. A coil spring unit is more resilient than foam, pushing back with essentially the same force when a load is removed, as it resists the load when it is added. Coils are typically much more consistent in firmness than foam, so any cushion made with coil content will typically be more consistent than a foam cushion.

Flammability is reduced compared to foam cushions. By-products of burning polyester fibers or polypropylene fabric are not as toxic or explosive as by-products of burning foam. The steel wire in the coil units is not flammable and creates no dangerous by-products.

Total environmental impact is minimized. The steel, fiber, and fabric components of the cushion all may contain a percentage of post-consumer recycled content. Fiber scrap from the manufacturing process is fully recyclable and can be re-processed into first quality batting for use in full-value products. Used steel components are fully recoverable. Used fiber components are fully and easily recycled.

The embodiments shown and described are merely for illustrative purposes only. The drawings and the description are not intended to limit in any way the scope of the claims. Those skilled in the art will appreciate various changes, modifications, and other embodiments. For example, the fiber pad can have one layer of a needle punched shoddy pad made from a combination of waste fibers that may include polyester, rayon, cotton acrylics and about 10% polypropylene fibers that is thermically bonded to a polyester loft layer having a minimum of 10% low melt fibers. This composition has the advantage of being low cost and also provides for an easily controllable insulation since the shoddy pad may offer thickness and density variations that affect the comfort factor of the cushion. For example, in an instance where the pocketed coils were to be very soft (in a back cushion, for example), the shoddy pad could be made with a thickness of ¾ inch, improving the insulation factor of the cushion to prevent the occupant from feeling the coil and at the same time reducing the thickness of the loft, thus reducing the cost of the cushion. Stated another way, an advantage of using the needle punched shoddy pad is the thickness and density can be varied without drastically affecting the cost since the raw material cost of the shoddy pad versus the layer of densified polyester is on the order of about three to ten. All such changes, modifications and embodiments are deemed to be embraced by the claims. Accordingly, the scope of the right to exclude shall be limited only by the following claims and their equivalents.

What is claimed is:

1. A furniture cushion comprising:

a matrix of interconnected pocketed springs, each spring of which is contained within a pocket of fabric;

foam surrounding at least three sides of the matrix of interconnected pocketed springs to create a foam assembly;

a fiber pad wrapped bull-nose around said foam assembly so as to cover an upper surface and a lower surface of said matrix of pocketed springs, said fiber pad having a first layer and a second layer in contact with said first layer, wherein said first layer has a first density and said second layer has a second density, said first density being greater than said second density.

2. The cushion of claim 1 wherein said fiber is polyester fiber.

3. The cushion of claim 2 wherein said first layer is a needle punched densified layer of said polyester fiber and said second layer is a loft layer of said polyester fiber.

4. The cushion of claim 3 wherein said first density ranges from about 3 pounds per cubic foot to about 10 pounds per cubic foot, and said second density ranges from about 0.5 pounds per cubic foot to about 2.5 pounds per cubic foot.

5. The cushion of claim 1 wherein said foam surrounds four sides of said matrix of pocketed springs.

6. The cushion of claim 5 wherein said fiber is polyester fiber.

7. The cushion of claim 6 wherein said first layer of said fiber pad is a needle punched densified layer of said polyester fiber and said second layer of said fiber pad is a loft layer of said polyester fiber.

8. The cushion of claim 7 wherein said first density ranges from about 3 pounds per cubic foot to about 10 pounds per cubic foot, and wherein said second density ranges from about 0.5 pounds per cubic foot to about 2.5 pounds per cubic foot.

9. The cushion of claim 1 further comprising an upholstery cover surrounding said foam assembly and said fiber pad.

10. The cushion of claim 1 wherein said springs are formed to be taller than said pockets, whereby said springs are pre-loaded in said pockets.

11. A furniture cushion comprising:

a foam assembly comprising a matrix of interconnected pocketed springs, each spring being contained within a pocket of fabric and foam surrounding the matrix of interconnected pocketed springs;

a fiber pad wrapped bull-nose around said foam assembly so as to cover an upper surface and a lower surface of said matrix of pocketed springs, said fiber pad having a first layer in contact with said upper and lower surfaces of said matrix of pocketed springs and a second layer in contact with said first layer, wherein said first layer has a first density and said second layer has a second density, said first density being greater than said second density.

12. The cushion of claim 11 wherein said fiber is polyester fiber.

13. The cushion of claim 12 wherein said first layer is a needle punched densified layer of said polyester fiber and said second layer is a loft layer of said polyester fiber.

14. The cushion of claim 13 wherein said first density ranges from about 3 pounds per cubic foot to about 10 pounds per cubic foot, and said second density ranges from about 0.5 pounds per cubic foot to about 2.5 pounds per cubic foot.

15. The cushion of claim 14 wherein said fiber pad wraps around a portion of the foam surrounding the matrix of interconnected pocketed springs.

16. The cushion of claim 11 wherein said springs are formed to be taller than said pockets, whereby said springs are pre-loaded in said pockets.

17. A furniture cushion comprising:

a matrix of interconnected pocketed springs, each spring of which is contained within a pocket of fabric;

a foam border surrounding three sides of said matrix of pocketed springs;

a fiber pad wrapped bull-nose around said matrix of pocketed springs so as to cover an upper surface, front end edges and a lower surface of said matrix of pocketed springs.

18. The cushion of claim 17 wherein said foam is polyethylene foam, and wherein said fiber is polyester fiber.

19. The cushion of claim 18 wherein a density of said polyethylene foam ranges from about 1.5 pounds per cubic foot to about 2.0 pounds per cubic foot, and a density of said polyester fiber ranges from about 0.5 pounds per cubic foot to about 2.5 pounds per cubic foot.

20. The cushion of claim 19 wherein said fiber pad has a first layer and a second layer in contact with said first layer, wherein said first layer has a first density and said second layer has a second density, said first density being greater than said second density.

* * * * *